United States Patent [19]

Byrne

[11] Patent Number: 5,022,468

[45] Date of Patent: Jun. 11, 1991

[54] AUTOMATIC SPRINKLER ACTIVATOR

[75] Inventor: Barry F. Byrne, Killarney Heights, Australia

[73] Assignee: Wormald International Limited, Crows Nest, Australia

[21] Appl. No.: 420,957

[22] Filed: Oct. 13, 1989

[30] Foreign Application Priority Data

Oct. 18, 1988 [AU] Australia ..... PJ1046

[51] Int. Cl.[5] ..... A62C 37/08

[52] U.S. Cl. ..... 169/40

[58] Field of Search ..... 169/38–41, 169/90

[56] References Cited

U.S. PATENT DOCUMENTS

| | | | |
|---|---|---|---|
| 1,030,299 | 6/1912 | Hammond | 169/39 |
| 1,165,313 | 12/1915 | Bower | 169/39 |
| 2,004,833 | 6/1935 | Rowley | 169/38 |
| 3,633,676 | 1/1972 | Gloeckler | 169/40 |
| 4,217,960 | 8/1980 | Miyazaki | 169/38 |

FOREIGN PATENT DOCUMENTS

| | | | |
|---|---|---|---|
| 1463609 | 3/1989 | U.S.S.R. | 169/38 |

*Primary Examiner*—Galen Barefoot
*Assistant Examiner*—Virna Lissi Mojich
*Attorney, Agent, or Firm*—Ladas & Parry

[57] ABSTRACT

An activator assembly for an automatic sprinkler head having a fluid flow control valve comprising releasable lever means serving to hold the valve closed, and a control assembly including a fusible element, heat conductive fin means and a retaining ring all mounted upon an axial post, the lever means abutting the retaining ring and being released by axial displacement of the retaining ring when the fusible element responds to a predetermined temperature.

10 Claims, 2 Drawing Sheets

AUTOMATIC SPRINKLER ACTIVATOR

This invention relates to automatic sprinkler heads serving for fire protection in enclosed spaces such as industrial or commercial buildings, or domestic dwellings.

Especially in the latter application there is a trend towards equipment which will achieve fast response to abnormal conditions. To this end numerous automatic sprinkler head assemblies have been proposed. Some of these are of an exposed type for lateral discharge of activating components when operated, such as described in U.S. Pat. No. 4,273,195 while others, such as described in U.S. Pat. Nos. 4,491,182, 4,508,175 and 4,596,289 and U.K. published Patent Application No. 2,155,328A, are of a flush type and provide for axial discharge of components. The construction of contemporary sprinkler heads, and heat responsive activators therefor, are so complex as to involve the use of so many components that assembly can only be achieved manually, and is time-consuming.

It is a principal object of the invention to provide a temperature responsive activator for an automatic sprinkler head which is of simple construction capable of ready assembly upon the sprinkler head. Ideally, such an assembly is so uninvolved as to be achievable by automatic machinery.

In accordance with the invention there is provided a heat responsive activator for an automatic sprinkler head, having a valve member for arresting the flow of fluid therefrom, comprising lever means which in a standby condition retains said valve member in a closed condition; and a control assembly engagable with said lever means to retain it in its standby condition and including relatively axially displaceable parts, and a fusible element normally functioning to maintain said parts in an axially expanded condition, said fusible element reacting when subjected to a predetermined temperature to permit axial contraction of said parts to thereby release said lever together with said control assembly for discharge from said sprinkler head.

The invention will be described in more detail with reference to the accompanying drawings, in which.

Figure 2:
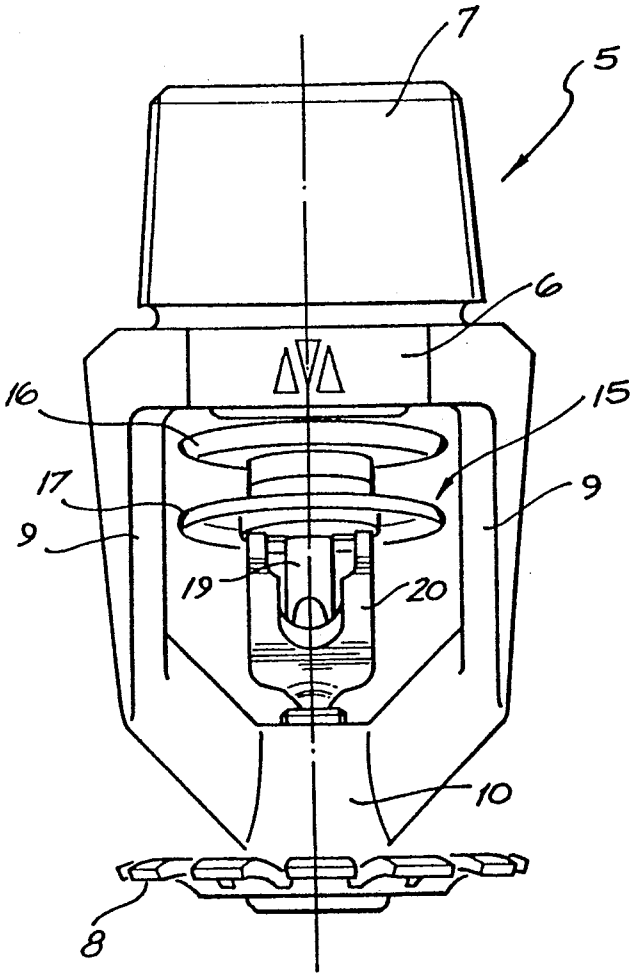
FIG. 2 is a side elevation of the sprinkler head and activator shown in FIG. 1.
Figure 1:
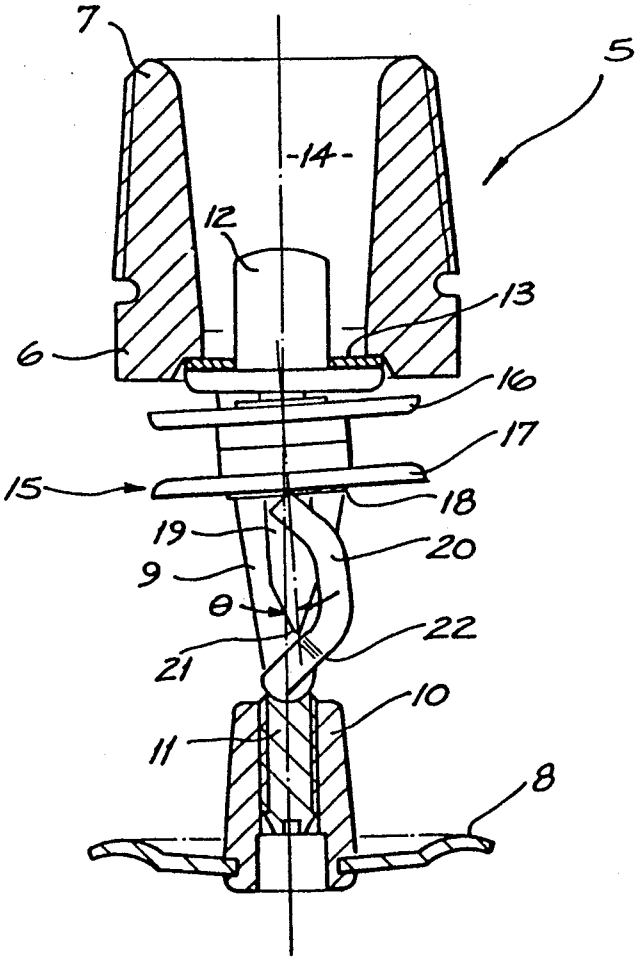
FIG. 1 shows in longitudinal section an automatic sprinkler head incorporating a temperature responsive activator according to a first embodiment of this invention.

The automatic sprinkler head 5 shown in FIGS. 1 and 2 comprises a housing 6 having a threaded end 7 for screwing into an adaptor (not shown) on a water supply line, and a deflector 8 supported spaced therefrom by depending arms 9. A central, internally threaded boss 10 is supported between the arms 9 and holds the deflector plate 8. An adjustment screw 11 is threaded into the boss 10 and a valve plug 12, together with a packing ring 13, when held against the open mouth of the water passage 14 through the head 5, serve to obstruct water flow therefrom onto the deflector 8 for discharge in a predetermined spray pattern over a fire protected area. A control, or activator, assembly 15 effects such closure of the valve plug 12.

The above-described construction is of a conventional form except for the form of control assembly 15 and cooperating lever means that is utilised. Hitherto, a soldered element or a frangible glass bulb has been used for the control assembly 15. These bulbs contain a liquid possessing a high temperature coefficient of expansion, but due to the poor heat conductivity of glass, they are relatively slow acting in response to the occurrence of a fire.

By the invention the assembly 15 is constructed of few parts readily capable of assembly, even by automatic machinery, and responds quickly to temperature variation. As shown in elevation in FIGS. 1 and 2, and in cross-section in FIG. 3 where a similarly constructed assembly 15 is employed, the assembly 15 consists of a laminar construction of two juxtaposed and contacting heat conducting circular fins 16 and 17 coaxial with and contacting an annulus 23 (FIG. 3) of eutectic solder. The fins 16 and 17 and solder annulus 23 as well as heat insulators, together with an abutting retaining ring 18 are assembled upon a post 19. A separate bent and bifurcated lever 20 is a further component of the control assembly 15. It will be appreciated that this assembly is of simple form and readily capable of being mass produced by automatic machinery. Assembly of the activator 15 upon the sprinkler head 5 can also be achieved simply, preferably by automatic machinery. To achieve this the activator assembly 15 is positioned with one end of the post 19 engaged with the valve plug 12 while the bent lever 20 is inserted between the retaining ring 18 and the adjustment screw 11 on the sprinkler head 5, with a pointed end 21 of the post 9 engaged within a peripheral groove 22 in the lever 20. By suitable adjustment of the screw 11, therefore, the water passage 14 is sealed closed by the valve plug 12. The manner in which automatic operation of the sprinkler head 5 occurs will be made clear in the following description of the second embodiment shown in FIG. 3.

Figure 3:
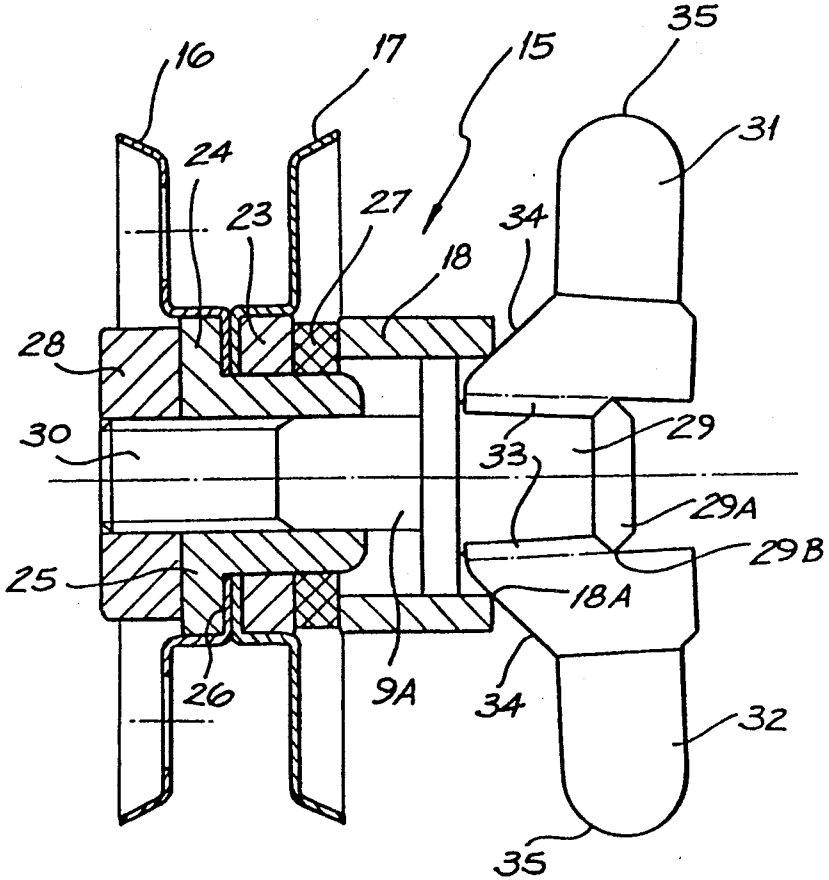
FIG. 3 is a sectional view through an activator according to a second embodiment of the invention; and, FIG. 4 is a similar view to that of FIG. 1 showing a third embodiment of the invention.

According to this second embodiment, which is of preferred construction, a similarly formed control assembly 15 is utilised which from FIG. 3 can be seen to incorporate the solder annulus 23 upon a sleeve 24 which has an enlarged head 25. The heat fins 16 and 17 have hub portions 26 in contact with each other and between the solder annulus 23 and the head 25. A heat insulating washer 27 abuts the outer face of the solder annulus 23 and separates it from the retaining ring 18. Essentially the sleeve 24 is of heat insulating material. The retaining ring 18 surrounds the outer end of the sleeve 24 extending beyond the insulating washer 27.

From this construction it can be appreciated that when heat gathered by the fins 16 and 17 is sufficient to melt the solder annulus 23 the retaining ring 18, if under compression, will be caused to move towards the head 25 of the insulating sleeve 24. Referring back to FIGS. 1 and 2, therefore, such axial contraction of the ring 18, which differs only in dimensions from the ring 18 of FIG. 3, with respect to the sleeve 24 will release the closing pressure upon the valve plug 12 so that due to the inclined mounting of the lever 20 and assembly 15 from the axis of the sprinkler head 5, at the angle $\theta$ shown in FIG. 1, the components of the activator are discharged laterally of the head 5 under the water pressure within the passage 14. With removal of the entire assembly 15 water will be free to impinge upon one face of the deflector 8 to create a predetermined spray pattern.

In the embodiment shown in FIG. 3 similar lateral discharge from a sprinkler head (not shown) of the components shown in this drawing will be achieved. In this instance all of the components may be pre-assembled upon a modified post 9A having a securing nut 28 at one threaded end 30 and an opposite end 29 provided with a projecting double chamfered annular rib 29A. In this instance a pair of diametrically opposed levers 31 and 32 are captured upon the post 9A by V-grooved inner ends 33 which partly encircle the post 9A. Capturing of the levers 31 and 32 is effected by screwing down the nut 28 so that diverging, external part conical surfaces 34 provided to one side of the inner ends of the levers 31 and 32 engage with an inner peripheral edge 18A of the retaining ring 18 while the peak 29B of the rib 29A serves as a fulchum for the levers 31 and 32. Mounting of the activator to a sprinkler head 5, with the nut 28 loosened, is achieved by engaging the outer end 35 of one of the levers 31 and 32 with the valve plug 12 (FIGS. 1 and 2), and the outer end 35 of the other lever with the inner end of the adjustment screw 11. The nut 28 is then tightened to secure the assembly. The axes of the levers 31 and 32 are tilted with respect to each other so that when the activator is mounted their conical surfaces 34 bear with force against the ring 18 due to water pressure tending to increase the tilt of the levers 31 and 32.

When the solder annulus 23 responds to a predetermined temperature and melts it will flow from the space between the hubs 26 of the fins 16 and 17 and the insulating washer 27. The retaining ring 18 will then be forceably displaced towards the hubs 26 by the force imposed by the conical surfaces 34, which under the pressure of water in the passageway 14 will cause the levers 31 and 32 to pivot, or tilt, about the fulcrum 29B to narrow the spacing between the ends 35 of the levers 31 and 32. As a consequence, the entire activator assembly 15 will be discharged laterally of the sprinkler head 5 and the valve plug will be released.

Figure 4:
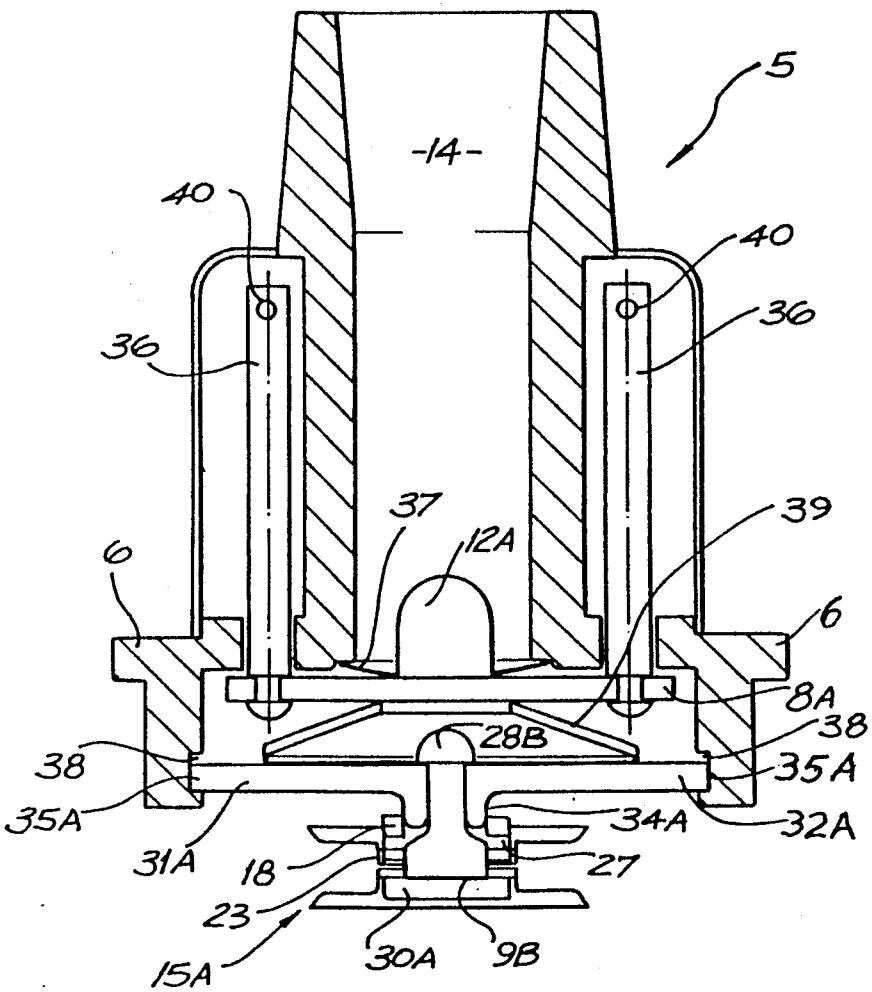

A third embodiment is depicted in FIG. 4 where discharge upon activation of the assembly 15A is effected axially of the sprinkler head 5. In this instance the deflector plate 8A is fixed upon a pair of slidable extension rods 36 and engages the valve plug 12A which includes a domed spring diaphragm valve 37 urging the deflector 8A downwardly.

A control assembly 15A, of similar form to that shown in FIG. 3, incorporates a pair of levers 31A and 32A of modified form. The post 9B preferably includes a head 28B adjacent the levers 31A and 32A, preferably with an adjustment nut 30A at its opposite end accessible externally of the head 5. The levers 31A and 32A also include inclined ramps 34A while the outer ends 35A of the levers engage within slots 38 internally of the sprinkler head housing 6. A domed spring 39 abuts the levers 31A and 32A and applies pressure to the underside of the deflector 8A to effect closure of the valve plug 12A.

When the solder annulus 23 responds to a predetermined temperature the retaining ring 18 will withdraw from the levers 31A and 32A and allow them to pivot about the post 9B to narrow the spacing between their ends 35A. In this embodiment the levers 31A and 32A do not require to be tilted with respect to each other. This will have the effect, under the pressure of the domed spring 39 and the internal water pressure in the passage 14, to unseat the levers 31A and 32A from their grooves 38 for axial discharge downwardly from the sprinkler head 5. With release of pressure by the domed spring 39 the deflector 8A will be displaced downwardly by water pressure until stops 40 at the ends of the rods 36 engage with the housing 6 for accurate spacing of the deflector 8A from the passage 14 for achievement of a predetermined water spray pattern within the protected area.

Whereas several embodiments have been described in the foregoing passages it should be understood that other forms, modifications and refinements are feasible within the scope of this invention.

What I claim is:

1. A heat responsive activator for an automatic sprinkler head, having a valve member for arresting the flow of fluid therefrom, comprising lever means to retain, in a standby condition, said valve member in a closed condition, a control assembly, having axially displaceable parts, engageable with said lever means to retain said control assembly in its standby condition, and a fusible solder annulus functioning to maintain said control assembly in its axially expanded condition, said solder annulus reacting when subjected to a predetermined temperature to permit axial contraction of said parts to thereby release said lever, together with said control assembly, from said sprinkler head, said control assembly including a post engageable with valve member and the lever means, and a retaining member about the post and engaging, in the operative condition, the lever means so as to apply pressure to the solder annulus, and wherein the solder annulus is positioned about the post and the retaining member is displaceable along the post to effect release of the lever means and control assembly from the sprinkler head when the solder annulus reacts to the predetermined temperature.

2. An activator according to claim 1, wherein said lever means is a bent and bifurcated lever engaged by one of its ends with said retaining member and the other of its ends with a deflector for said sprinkler head.

3. An activator according to claim 1, further comprising an adjustment nut on a threaded end of said post, heat conductive fin means in heat conduction with the fusible annulus, and means upon said post heat insulating said fin means and said fusible annulus therefrom.

4. An activator according to claim 1, wherein said control assembly also comprises heat conductive fin means encircling said post and in heat conductive contact with said fusible solder annulus, and heat insulation means upon said post to isolate said fin means and said fusible solder annulus from said post.

5. An activator according to claim 1, wherein closing pressure upon said valve member is determined by manually adjustable means axially advanceable with respect to said post.

6. An activator according to claim 1, wherein said lever means comprises a pair of diametrically opposed levers retained upon said post by their engagement with said retaining member and released from said post with said displacement of the retaining member on said post.

7. An activator according to claim 6, wherein the retaining member is a retaining ring and wherein each of said levers has a ramp surface engaging with said retaining ring to hold said levers upon said post.

8. An activator according to claim 1, wherein the control assembly is positioned at an acute angle with respect to the upright axis of the sprinkler head.

9. An activator according to claim 8, wherein the lever means is positioned at an acute angle with respect to the upright axis of the sprinkler head.

10. An activator according to claim 1, wherein the control assembly and the lever means are positioned at an acute angle $\theta$ with respect to the upright axis of the sprinkler head.

* * * * *